US010862228B2

(12) United States Patent
Thakare et al.

(10) Patent No.: US 10,862,228 B2
(45) Date of Patent: Dec. 8, 2020

(54) CABLE CONNECTOR AND METHOD OF TERMINATING A CABLE

(71) Applicant: Amphenol Corporation, Wallingford, CT (US)

(72) Inventors: Rakesh Thakare, Cary, NC (US); Iuliu Cosmin Gordea, Holly Springs, NC (US); Caichun Song, Changzhou (CN); Stefan Nicholas Hoogendoorn, Houten (NL); Nicholas Padfield, Rugby (GB); Keith Mothersdale, North Yorkshire (GB)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 16/406,128

(22) Filed: May 8, 2019

(65) Prior Publication Data

US 2019/0348777 A1 Nov. 14, 2019

Related U.S. Application Data

(60) Provisional application No. 62/781,826, filed on Dec. 19, 2018, provisional application No. 62/668,534, filed on May 8, 2018.

(51) Int. Cl.
*H01R 9/05* (2006.01)
*H01R 43/00* (2006.01)

(52) U.S. Cl.
CPC ..... *H01R 9/0524* (2013.01); *H01R 43/00* (2013.01)

(58) Field of Classification Search
CPC ..... H01R 9/0524; H01R 43/00
USPC ..... 439/578, 579, 580–85, 596
See application file for complete search history.

(56) References Cited

U.S. PATENT DOCUMENTS

| | | | | |
|---|---|---|---|---|
| 3,206,540 | A * | 9/1965 | Cohen | H01R 9/0521 174/89 |
| 4,138,184 | A * | 2/1979 | Knopp | H01R 4/245 439/399 |
| 4,744,764 | A * | 5/1988 | Rubenstein | H01R 12/62 439/260 |
| 4,854,893 | A | 8/1989 | Morris | |
| 6,217,381 | B1 * | 4/2001 | Kameyama | H01R 9/0518 439/578 |
| 7,762,841 | B2 * | 7/2010 | Ho | H01R 9/0518 439/582 |
| 7,980,894 | B1 * | 7/2011 | Hall | H01R 24/40 439/585 |
| 9,537,231 | B2 * | 1/2017 | Hall | H01R 9/0518 |
| 2012/0202372 | A1 * | 8/2012 | Hardy | H01R 9/0518 439/460 |

(Continued)

FOREIGN PATENT DOCUMENTS

| | | |
|---|---|---|
| EP | 2 595 247 A2 | 5/2013 |
| JP | 2011 166975 A | 8/2011 |

OTHER PUBLICATIONS

European Search Report from EP Application No. 20167134.4 dated Jul. 1, 2020.

*Primary Examiner* — Peter G Leigh
(74) *Attorney, Agent, or Firm* — Blank Rome LLP

(57) ABSTRACT

A cable connector and methods for terminating a coaxial cable to the cable connector, designed to facilitate assembly to and proper termination of the cable with improved grounding between the connector and the cable.

27 Claims, 9 Drawing Sheets

(56) References Cited

U.S. PATENT DOCUMENTS

2017/0138388 A1* 5/2017 Figge ..... F16B 37/041

* cited by examiner

CABLE CONNECTOR AND METHOD OF TERMINATING A CABLE

RELATED APPLICATIONS

This application claims priority to U.S. Provisional Application No. 62/668,534, filed on Jun. 8, 2018 and entitled Cable Connector With Improved Grounding, and U.S. Provisional Application No. 62/781,826, filed on Dec. 19, 2018 and entitled Cable Connector, the subject matter of each is incorporated herein.

FIELD OF THE INVENTION

The present invention relates to a cable connector and method of terminating a cable, designed to facilitate proper assembly to and termination of a cable, such as a coaxial cable, thereto.

BACKGROUND

The CATV industry has standardized coaxial cable connectors, such as compression F type coaxial connectors. These connectors typically have a ferule post, which inserts into a prepared end of the cable, in particular between the coaxial cable center dielectric and the conductive braiding of the cable. This interconnection terminates the cable to the F connector and provides a grounding connection between the F connector and the coaxial cable, which is one of the more important aspects of any RF (Radio Frequency) circuit/transmission line. The conventional design of F connectors, however, often makes it difficult to properly terminate the cable to the connector.

Also, joining two separate interconnect parts in any RF circuit is a major challenge, particularly with regard to appropriate grounding. This is the issue of many Broadband Cable companies which utilize coaxial cable, particularly cable with unalloyed Aluminum braiding, which entails the F connector's post connecting with a highly volatile material (i.e. unalloyed Aluminum) which oxidizes in the presence of air and moisture or general contamination from fingers, etc. This can have a dire effect on overall RF performance of the interconnection, including CPD (Common Path Distortion), RFI screen degradation, and eventually overall RF signal failure.

Current F connectors compress the interconnect parts via the cable's PVC outer jacket. That is, the PVC jacket is compressed onto the cable's braiding, which intern applies pressure on to the F connector's post, thus providing metal-to-metal grounding contact between the coaxial cable and F connector. However, this technique is problematic because sufficient pressure cannot be maintained on the cable braiding/post connection because of the poor tensile strength of the PVC jacket material. This poor tensile strength means the compression force on the jacket often exceeds the PVC polymer material's tensile strength as well as the elongation break percentage of the material, as seen in FIGS. 12A and 12B and 13A and 13B.

FIG. 12B shows how the PVC polymer structure of the cable jacket 12 has been permanently deformed at area A following a pressure exceeding its tensile strength, like when the coaxial PVC cable 10 is compressed within a typical F connector, as shown in FIG. 12A. As seen in FIG. 13A, the only pressure being applied to the cable's braiding 14 onto the post 16 is in the two small points of compression at B. The remaining cable braiding sits loose over the bulk of the post. FIG. 13B shows the PVC jacket 12 deformed due to the excessive pressure from the points of compression B. The PVC jacket 12 also suffers from further thinning due to material creep once exposed to temperature extremes during use. This results in the grounding interconnect between the cable braiding 14 and connector's post 16 degrading, as the pressure diminishes over time. This also makes it difficult to keep air and moisture out of the cable interconnect, as the initial seal between the F connector and the PVC cable jacket 12 is compromised, resulting in the eventual loss of pressure of the cable braiding onto the connector's post and grounding integrity.

SUMMARY

The present invention may provide a cable connector that comprises an inner subassembly having a coupling end for coupling to a mating connector or port and a post end for electrically connecting to a cable; and an outer body that comprises separable half sections forming an inner bore that receives at least the post end of the inner subassembly. Each half section has a proximal end and a distal end. The distal ends are configured to accept the cable. Each half section has at least one engagement feature that cooperates with at least one corresponding engagement feature of the other half section for assembly of the half sections together in a closed position around the inner subassembly.

In certain embodiments, the outer body further comprises a connecting piece connecting the proximal ends of the half sections, and the connecting piece is coupled to a transition portion of the inner subassembly between the coupling and post ends; the connecting piece is press-fit onto the transition portion of the inner subassembly; and/or the connecting piece has a keying feature that engages a corresponding keying feature of the transition portion.

In other embodiments, at least one of the inner subassembly or the outer body is a unitary one-piece member; the inner subassembly is formed of a conductive material and the outer body is formed of a dielectric material; the engagement features of the half sections are located at the distal ends thereof, respectively; the half sections include another set of engagement features at or near the proximal ends, respectively; the engagement features form a snap engagement; and/or the connector further comprising a creep compensation insert received in the inner bore of the outer body.

The present invention may also provide a coaxial cable connector assembly that comprises a cable that has inner and outer conductors and an outer jacket and a coaxial connector. The connector comprises an outer body that has half sections configured to engage one another to faun an inner bore and an inner subassembly with a post end receivable in the inner bore of the outer body. The post end is inserted into a prepared end of the cable so that the outer conductor of the cable is in electrical grounding contact with the post. A creep compensation insert is received in the inner bore between the post end and inner surfaces of the half sections. The creep compensation insert is configured to limit material creep of the outer jacket of the cable terminated to the coaxial connector.

In some embodiments, the creep compensation insert is formed of silicone and the outer jacket of the cable is formed of PVC; two creep compensation inserts are received in respective recessed areas in the inner surfaces of the half sections of the outer body and surrounding the post end; the creep compensation insert is a sleeve that includes first and second parts shaped to be received in the respective recessed areas of the half sections of the connector body; and/or the outer body is formed of a dielectric material and is a unitary one-piece member.

The present invention may yet further provide a method of terminating a cable with a cable connector where the cable connector comprises an outer body and an inner subassembly, that comprises the steps of assembling the outer body to the inner subassembly by coupling a connecting piece of the outer body with a portion of the inner subassembly and with separable half sections of the outer body being disengaged and in an open position; after assembling the outer body to the inner subassembly, terminating a prepared end of the cable with a post end portion of the inner subassembly, thereby electrically connecting the cable and the inner subassembly, while the half sections of the outer body remain disengaged and in the open position; and after terminating the prepared end of the cable with a post end portion of the inner subassembly, assembling the half sections together via cooperating engagement features to a closed position, thereby clamping the cable between.

In other embodiments, the step of assembling the half sections of the outer body together includes snap fitting the half sections; the method further comprises the step of releasing the cooperating engagement features to disengage the half sections of the outer body from the cable and move the half sections to the open position; and/or the outer body of the connector is dielectric and the inner subassembly is conductive.

The present invention may further provide a method of terminating a cable with a coaxial cable connector that comprises the steps of providing a cable comprising an inner conductor, an outer conductor, and an outer jacket formed of dielectric material; preparing a termination end of the cable by, removing an end portion of the outer jacket at the termination end of the cable to expose a portion of the outer conductor commensurate with the end portion removed from the outer jacket, forming one or more lateral slits in a predetermined portion of the outer jacket and in the outer conductor, at the termination end of the cable, and folding back the exposed portion of the outer conductor to provide a post lead-in at the termination end of the cable; and installing the coaxial connector onto the termination end of the cable by inserting a post end of the coaxial connector into the post lead-in of the outer conductor, thereby electrically connecting the outer conductor of the cable and the post end of the coaxial connector.

In certain embodiments of the method, a length of the one or more lateral slits of the predetermined portion of the outer jacket is generally the same as the length of a cable termination end of the post; the outer jacket slits at the one or more lateral slits when the post end is inserted into the termination end of the cable; the one or more lateral slits are two lateral slits located on opposite sides of the outer jacket; the method further comprises the step of clamping the termination end of the cable between half sections of an outer body of the coaxial cable connector; the method further comprises the step of snap fitting together the half sections around the post end of the coaxial cable connector when claiming the termination end of the cable; and/or the method further comprises the step of inserting a creep compensation insert in the outer body prior to clamping the termination end of the cable, the creep compensation insert is configured to limit material creep of the outer jacket when clamping the termination end thereof.

In other embodiments, the creep compensation insert is a unitary one-piece sleeve inserted over the post end and/or two creep compensation inserts are inserted into a recess of one of the half sections of the outer body of the coaxial cable connector.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENT

Figure 1:
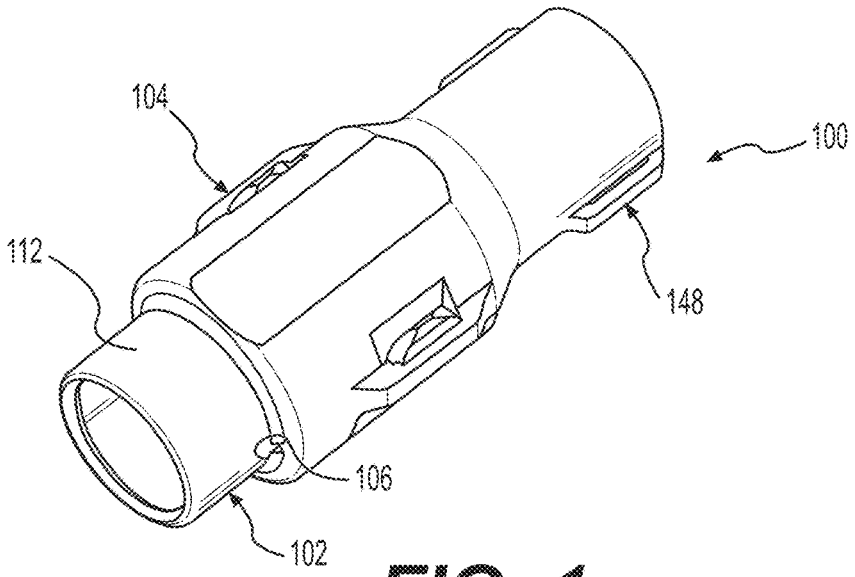
FIG. 1 is a perspective view of a cable connector according to an exemplary embodiment of the present invention, showing an outer body thereof in a closed (assembled) position.

Referring to the figures, the present invention relates to a cable connector 100 and methods for terminating a coaxial cable 10 to the same, that facilitates assembly to and proper termination of the cable. In general, the cable connector 100 according to an exemplary embodiment of the present invention comprises an inner subassembly 102 and an outer body 104 at least partially surrounding the inner subassembly 102. In a preferred embodiment, the inner subassembly 102 is formed of any metal or conductive material for electrical connection with the cable and the outer body 104 is formed of any plastic or dielectric material.

In one embodiment, the method for terminating the coaxial cable 10 to the connector according to the present invention improves grounding therebetween. The cable connector 100 may be structured to provide a 360° or near 360° grounding surface area and uniform or substantially uniform constant pressure between the cable 10 and the post or post end 110 of the connector 100. The connector 100 is designed to optimize the grounding interconnect between the connector's post or post end 110 and the cable's outer conductor or braiding 14, such as by optimizing the metal-to-metal contact between the post or post end 110 and cable braiding 14 by using the maximum surface area of the post or post end 110 and cable braiding 14; applying a uniform constant pressure over the braiding 14 onto the connector post or post end 110; and/or ensuring the interconnect is hermetically sealed from air and moisture when assembled.

The connector and methods of the present invention are designed to optimize the grounding interconnect between the connector 100 and the cable 10 while also allowing for the standard steps in cable preparation, such as folding the cable braiding 14 back over the cable's outer jacket 12 to provide a lead-in for the connector's post end 110. The connector and methods of the present invention also prevent damage or distortion to the cable braiding 14 by the post end 110, which in turn provides optimum metal-to-metal contact between cable braiding 14 and connector post end 110. In addition, the connector and methods of the present invention prevent the installer/technician from inadvertently touching the cable braiding 14, thus preventing any possible contamination to the interconnection point. The present invention further provides material creep compensation of the cable's outer jacket 12, while being able to apply a uniform or near uniform nominal pressure over the length of the cable braiding/post interconnect without deforming the cable jacket material, which is typically a PVC material.

Figure 5A:
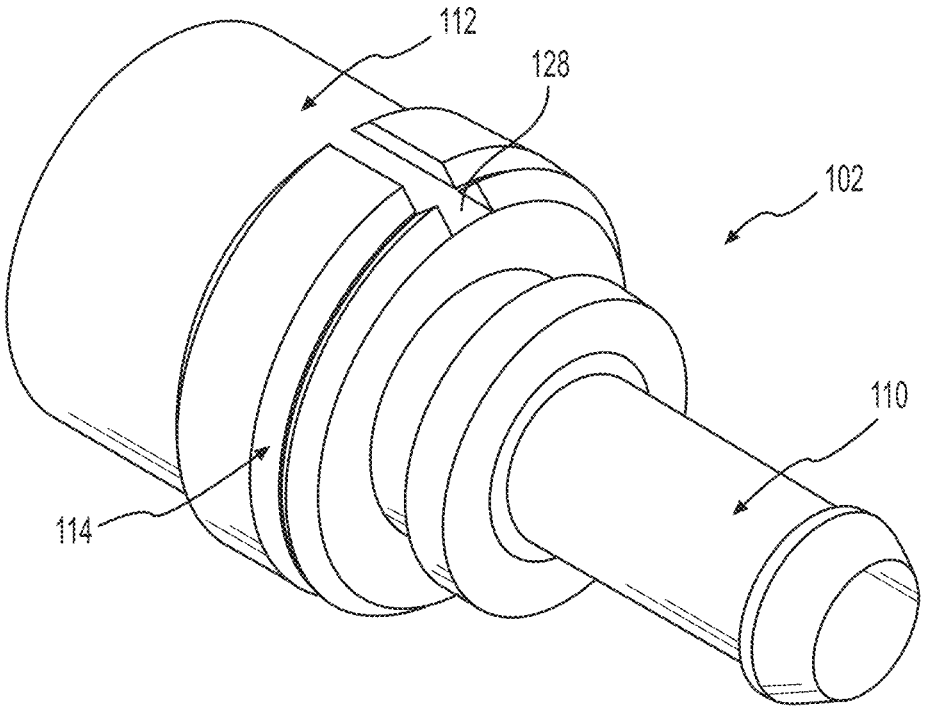
FIGS. 5A and 5B are perspective views of an inner subassembly of the cable connector illustrated in FIG. 1.
Figure 5B:
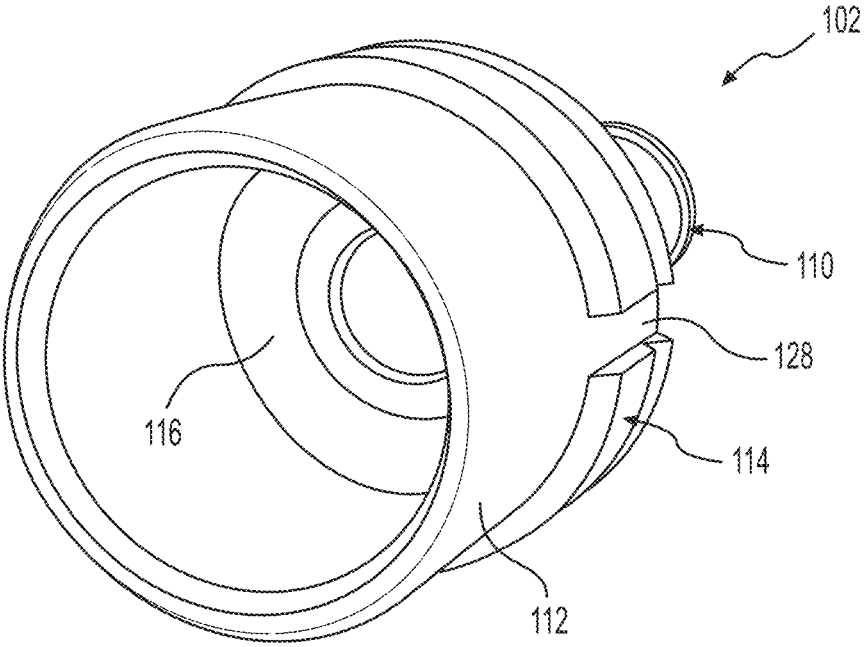

Inner subassembly 102 may comprise a post end 110, an opposite coupling end 112, and a transition portion 114 therebetween, as best seen in FIGS. 5A and 5B. Coupling end 112 may be similar to a coupling nut of a coaxial cable connector, for example, configured to mate with another connector or a mating port, such as by threading or pushing the coupling end 112 onto the mating port. In one embodiment, the coupling end 112 may include an inner spring 115 (FIG. 6) to assist with mechanical and electrical engagements with the mating connector or post. Post end 110 may be similar to a post of a coaxial cable connector, for example, that is configured to terminate a prepared end of the cable 10, thereby electrically connecting the post end 110 and the cable. Transition portion 114 is designed to support outer body 104. Transition portion 114 may include an inner shoulder 116 at or near the post end 110 and in communication with the coupling end 112 for electrical contact with the mating port. In a preferred embodiment, the post end 110, the coupling end 112, and the transition portion 114 form a unitary one-piece member.

Figure 2:
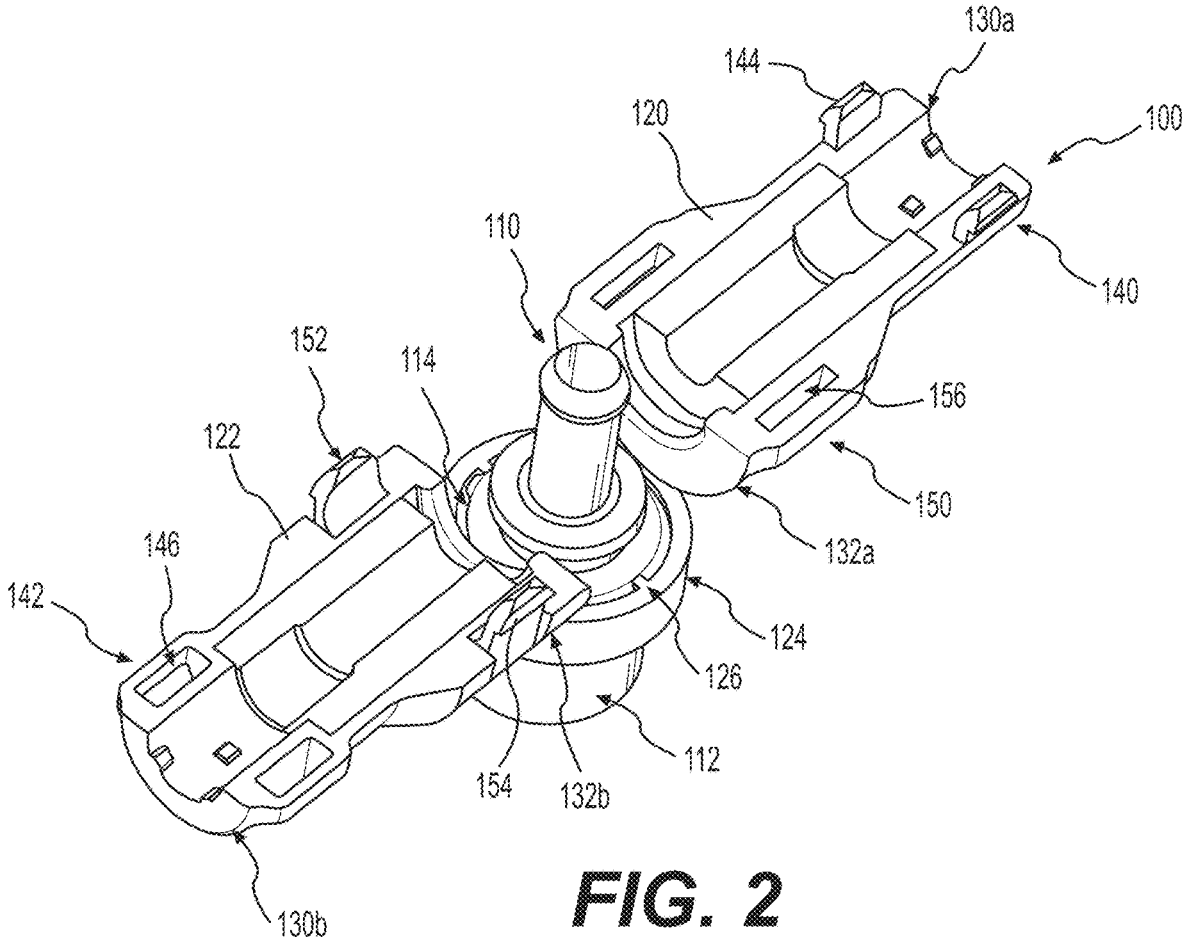
FIG. 2 is a perspective view of the cable connector illustrated in FIG. 1, showing the outer body in an open (non-assembled) position.
Figure 4:
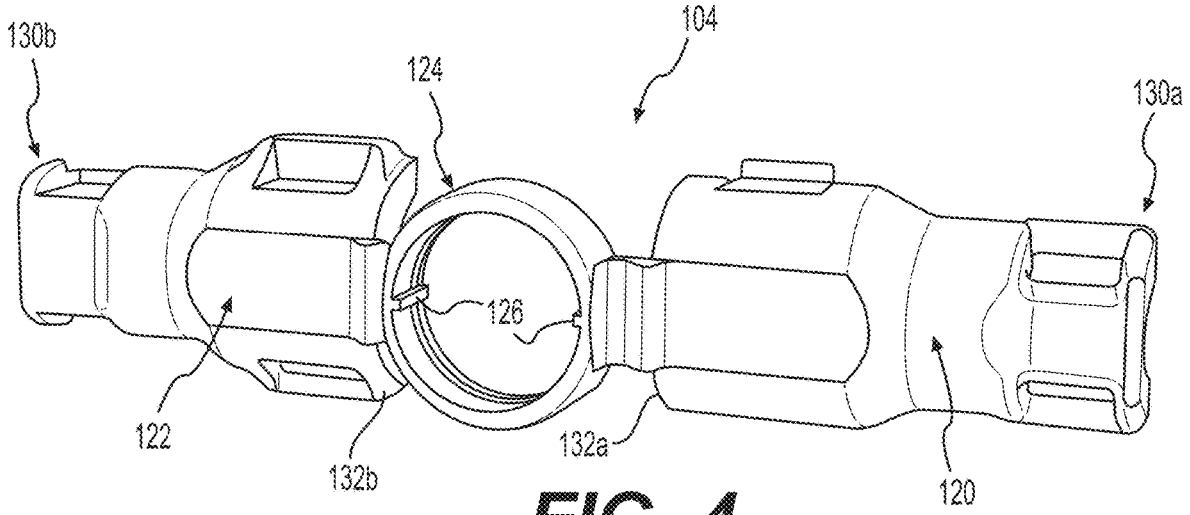
FIG. 4 is a perspective view of the outside of the outer body of the cable connector illustrated in FIG. 1.
Figure 6:
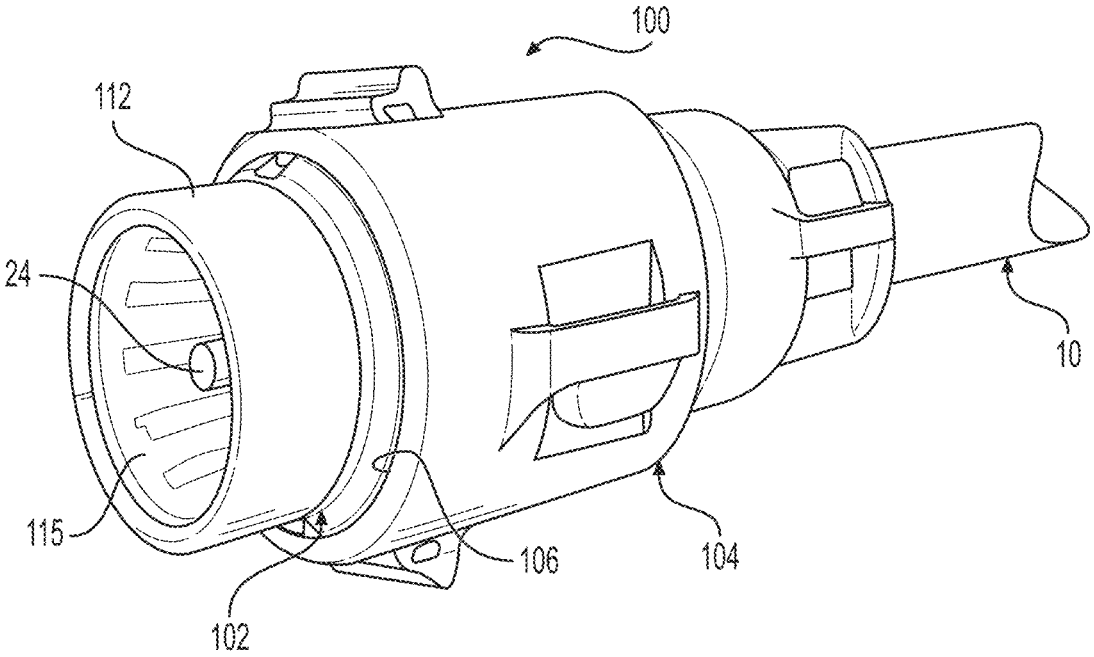
FIG. 6 is a perspective view of the cable connector according to an exemplary embodiment of the present invention.
Figure 7:
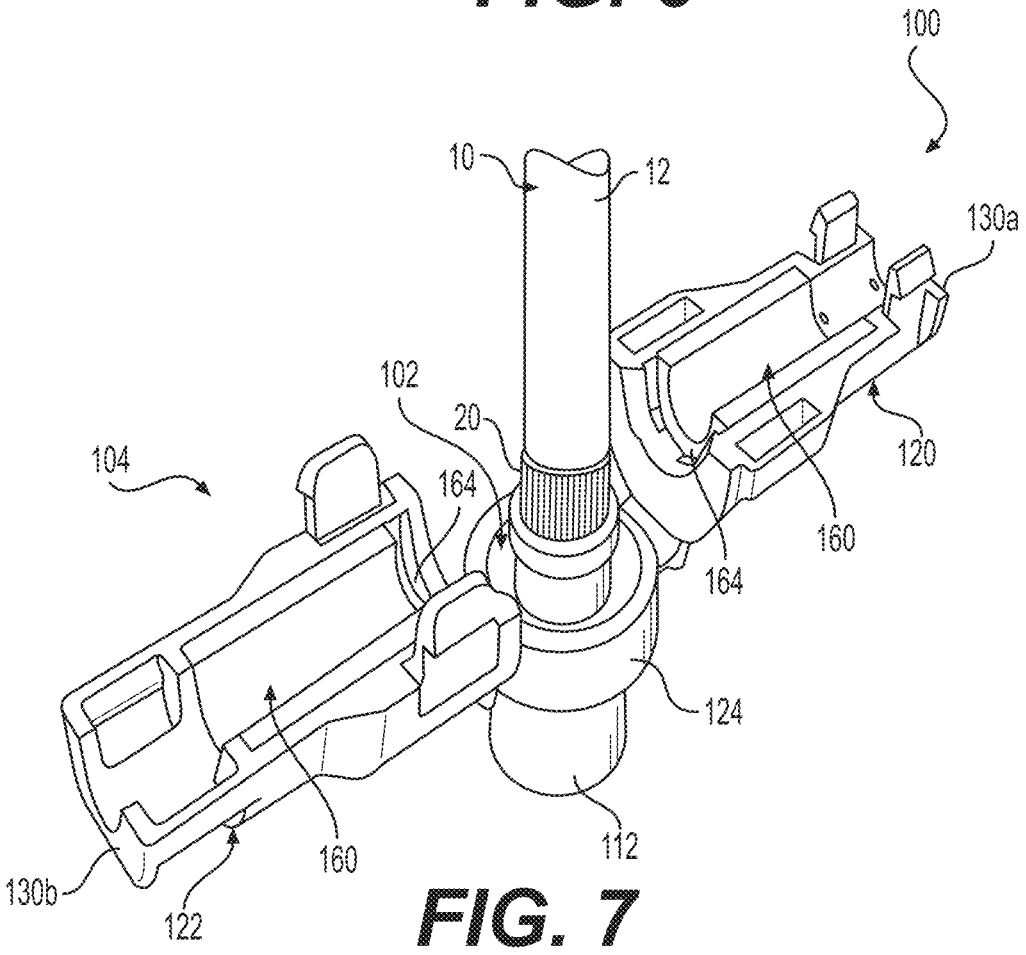
FIG. 7 is a perspective view of the connector illustrated in FIGS. 1 and 6, showing the connector in an open position with creep compensation inserts provided therein and a prepared end of the cable terminated to the connector.

Outer body 104 surrounds at least the post end 110 of the inner subassembly 102, and may also extend over the transition portion 114 leaving at least part of the coupling end 112 exposed, as seen in FIGS. 1, 2, and 6. Outer body 104 may comprise separable half sections 120 and 122 connected by a connecting piece 124. The half sections 120 and 122 may be assembled together over the inner assembly 102 in a closed position, as seen in FIG. 1, to form an inner bore 106. FIGS. 2 and 7 show the half sections 120 and 122 in an open non-assembled position and the prepared end of the cable 10 terminated to the post end 110. Connecting piece 124 may comprise a ring body, as seen in FIGS. 2 and 4, that couples to the transition portion 114 of inner subassembly 102, such as by a press fit. In one embodiment, connecting piece 124 includes one or more keying features 126 (FIGS. 2 and 4), such as an inwardly extending detent or detents, that engages one or more corresponding key features 128 (FIG. 5B), such as a notch or notches, on the transition portion 114 of the inner subassembly 102. In a preferred embodiment, the half sections 120 and 122 and the connecting piece 124 form a unitary one-piece outer body.

Half sections 120 and 122 of outer body 104 may have distal ends 130*a* and 130*b*, respectively, opposite proximal ends 132*a* and 132*b* and remote from the connecting piece 124, that are configured to accept the cable when the half sections 120 and 122 are assembled in the closed position. Releasable engagement features are preferably provided on the inside of the half sections 120 and 122 for assembling the half sections 120 and 122 together. The distal ends 130*a* and 130*b* preferably include a set of cooperating engagement features 140 and 142. Proximal ends 132*a* and 132*b* that are opposite the distal ends 130*a* and 130*b*, respectively, may include another set of cooperating engagement features 150 and 152. In one embodiment, the engagement feature 140 on distal end 130*a* of half section 120 and the engagement feature 152 at the end 132*b* of the other half section 122 may be one or more inwardly extending tabs 144 and 154, respectively; and the corresponding engagement feature 142 on distal end 130*b* of the half section 122 and the corresponding engagement feature 150 on the end 132*a* of the half section 120 may be one or more openings 146 and 156, respectively, sized to receive the tabs 144 and 154, respectively, in a snap fitting engagement. It will be understood that the tabs and openings of the engagement features may be provided on any portion or end of the outer body half sections 120 and 122, and in any arrangement, as long as the half sections 120 and 122 may be releasably engaged to one another. It will also be understood that other known engagements may be used to assemble the half sections 120 and 122 together at their distal ends 130*a* and 130*b* and their opposite ends 132*a* and 132*b*. In one embodiment, the free ends 148 of the tabs 144 at distal ends 130*a* and 130*b* may extend through and past the openings 146 such that the free ends 148 are exposed outside of the outer body 104, as seen in FIG. 1, thereby facilitating release of the snap engagement and separation of the half sections 120 and 122 to the open non-assembled position.

Figure 3:
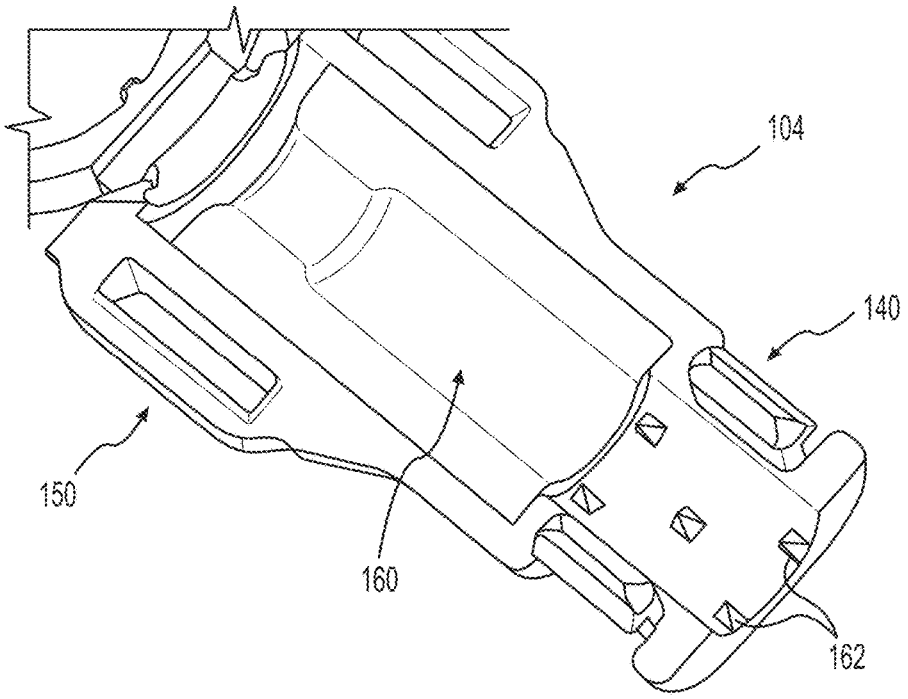
FIG. 3 is a partial perspective view of the inside of the outer body of the cable connector illustrated in FIG. 1.

Each of the outer body half sections 120 and 122 may include a creep compensation insert or lining 160 respectively, on an inner surface thereof, respectively as seen in FIGS. 2 and 7. The inserts 160 are configured to form a compression sleeve when the half sections are assembled onto the cable and designed to compress the prepared end of the cable. The inserts 160 may be a dielectric material, such as silicone or a stepped silicone lining, for example. The inner surfaces of the half sections 120 and 122 may also include cable jacket retention features 162 configured to grab the outer jacket 12 of the cable. The cable jacket retention features 162 may be positioned at the distal ends 130*a* and 130*b* of each half section, respectively. The retention features 162 may be, for example, one or more inwardly extending teeth, which may be located adjacent to or near each insert 160, as seen in FIG. 3.

Figure 8A:
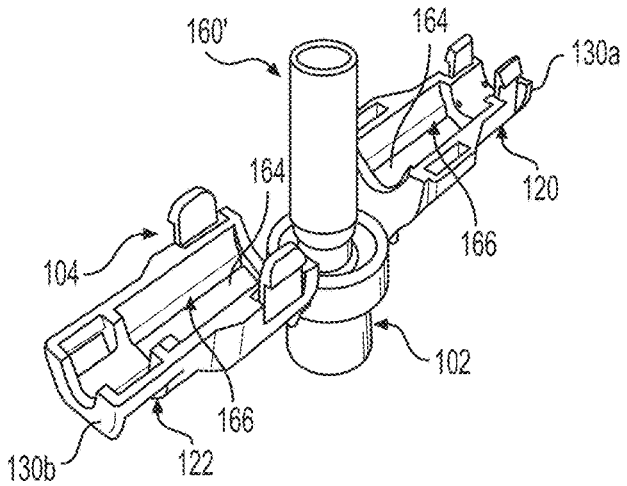
FIGS. 8A and 8B are exploded views of the connector illustrated in FIGS. 1 and 6, showing a creep compensation insert according to another exemplary embodiment of the present invention.
Figure 8B:
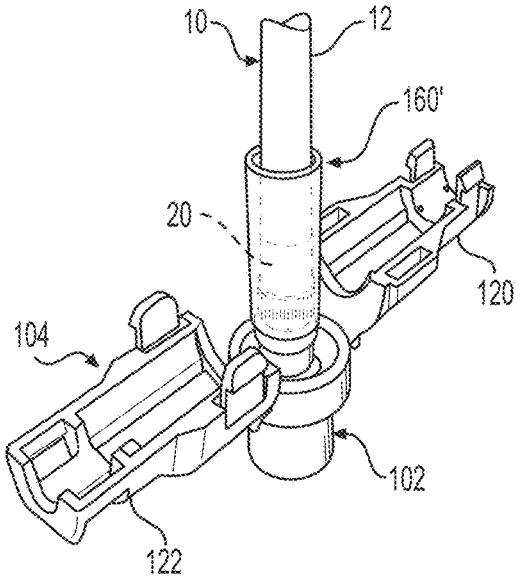

Each creep compensation insert 160 is receivable in the connector body's inner bore 106 between the post end 110 and the inner surface of each half section 120 and 122. Each creep compensation insert 160 is preferably configured to limit material creep of the outer jacket 12 (FIG. 7) of the cable 10. In one embodiment, the inserts 160 comprises first and second sleeve parts or halves designed to fit in recessed areas 164 of the inner surfaces of the connector body's half sections 120 and 122, respectively. In an alternative embodiment, the insert 160' may be a unitary one-piece sleeve, as seen in FIGS. 8A and 8B, that fits around the post end 110 with space therebetween for receiving the prepared end 20 of the cable 10.

Creep compensation inserts 160 or sleeve 160' may be formed of any rubber or rubber-like material with a specific sure hardness that will provide material creep compensation at the point of compression of the cable's outer jacket 12, when clamping the outer body's half sections 120 and 122 together, and maintain pressure at this point after the outer jacket 12 has deformed. Material creep (or cold flow) is the tendency of a solid material, particularly plastics, to move slowly or deform permanently under the influence of mechanical stresses. It can occur as a result of long-term exposure to high levels of stress that are still below the yield strength of the material. In a preferred embodiment, the insert 160 or sleeve 160' is formed of silicone rubber which has a sure hardness that is less than the tensile strength and elongation break percentage of PVC, which is the most common material for the cable's outer jacket 12. That is, the silicone inserts or sleeve are softer than the PVC outer jacket. Although silicone is preferred, any material that has the same or similar type sure hardness and tensile strength Mpa (Newton per square meter force) along with a high elongation break percentage can also be used. The inner surfaces of the connector body's half sections 120 and 122 may have expansion relief grooves 166 (FIG. 8A) therein that allow expansion of the inserts 160 or sleeve 160.

A method of assembling the cable connector 100 and terminating a cable therein, according to the present invention, may comprise the steps assembling the outer body 104 to the inner subassembly 102 by coupling the connecting piece 124 of the outer body 104 with a portion of the inner subassembly 102. For example, the ring body of the connection piece 124 may be press fit onto the transition portion 114 of the inner subassembly 102. When coupling the connection piece 124 to the inner subassembly 102, the outer body's half sections 120 and 122 are disengaged and in an open position. Then a prepared end of the cable may be terminated to the post end 110 of the inner subassembly 102 with the half sections 120 and 122 of the outer body 104 remaining in the open position. Because the outer body half sections 120 and 122 are open, the installer may easily see inside of the connector 100 and thus see whether the prepared end of the cable has been properly terminated to the post end 110. In an embodiment, the cable's outer jacket may sit flush with a front face 116 (FIG. 5B) of the connector body 114, upon termination of the cable.

Once the cable end has been properly terminated, the outer body half sections 120 and 122 may be assembled together via the cooperating engagement features 140, 142 and 150, 152 to a closed position, thereby clamping the cable therebetween to ensure a proper mechanical and electrical connection to the cable connector 100.

Figure 9A:
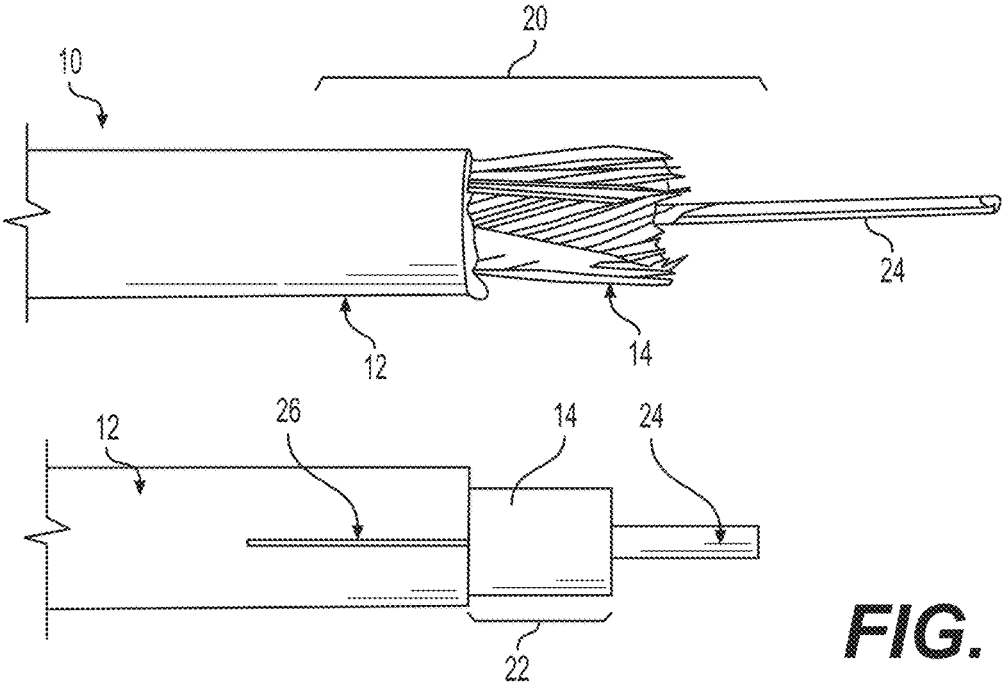
FIGS. 9A-9D illustrates the steps of terminating a coaxial cable to the connector illustrated in FIGS. 1 and 6 according to an exemplary method of the present invention.
Figure 9B:
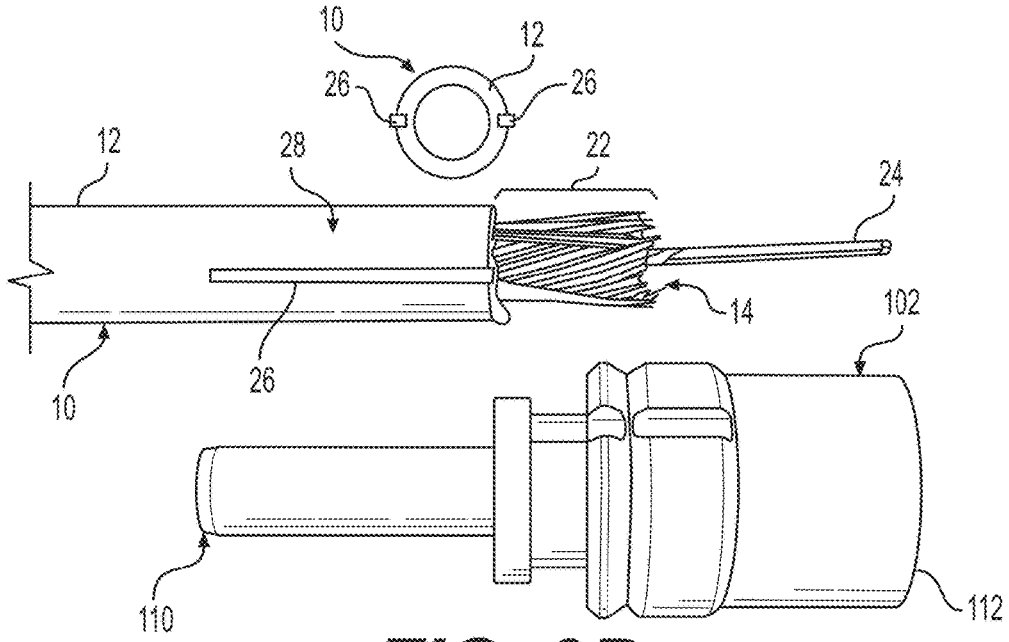

An exemplary method of terminating the cable 10 with the coaxial connector 100 may initially comprise preparing the termination or prepared end 20 of the cable for receiving the connector's post end 110. Initially, an end portion of the cable's outer jacket 12 at the termination end 20 is removed to expose a portion 22 of the outer conductor or braid 14, the portion 22 being commensurate with the end portion removed from the outer jacket 12, as seen in FIG. 9A, The cable's inner conductor 24 is also exposed and extends beyond the outer conductor or braid 14. Next, one or more lateral slits 26 are formed in a predetermined portion 28 of the outer jacket 12 and in the outer conductor or braid 14, at the cable's termination end 20. In an embodiment, the one or more lateral slits 26 and the jacket's predetermined portion 28 have a length substantially equal to the length of the connector's post end 110, as seen in FIG. 9B. In an embodiment, there are two lateral slits 26 formed on opposite sides of the cable's outer jacket 12, as seen in FIG. 9B.

Figure 10:
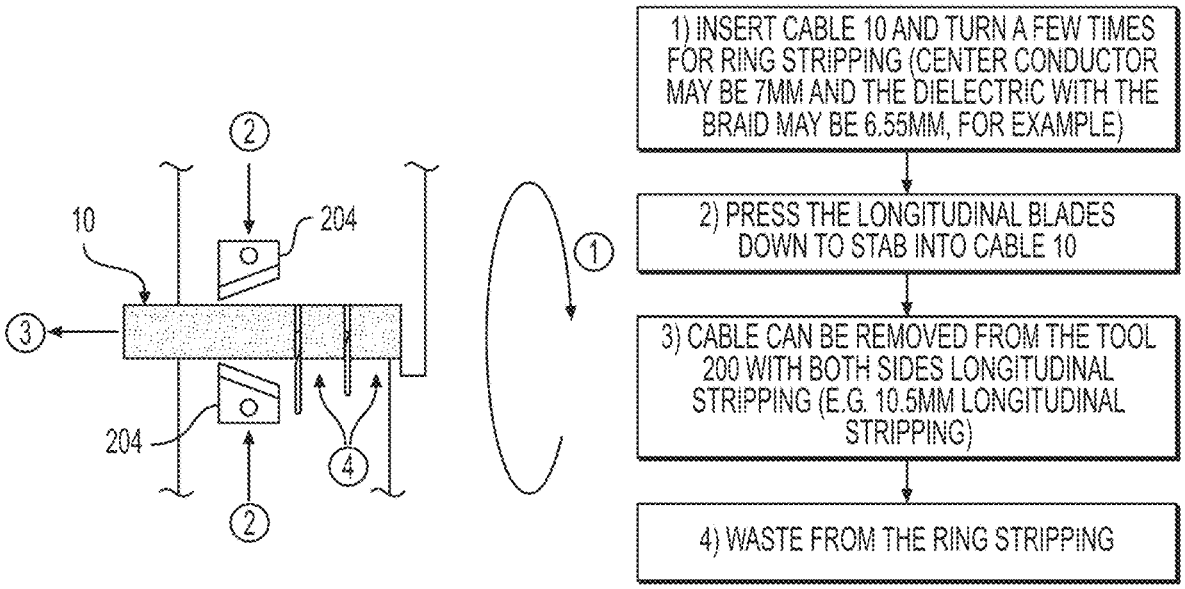
FIG. 10 shows steps for preparing a cable for termination to the connector illustrated in FIGS. 1 and 6.
Figures 11A, 11B, 11C:
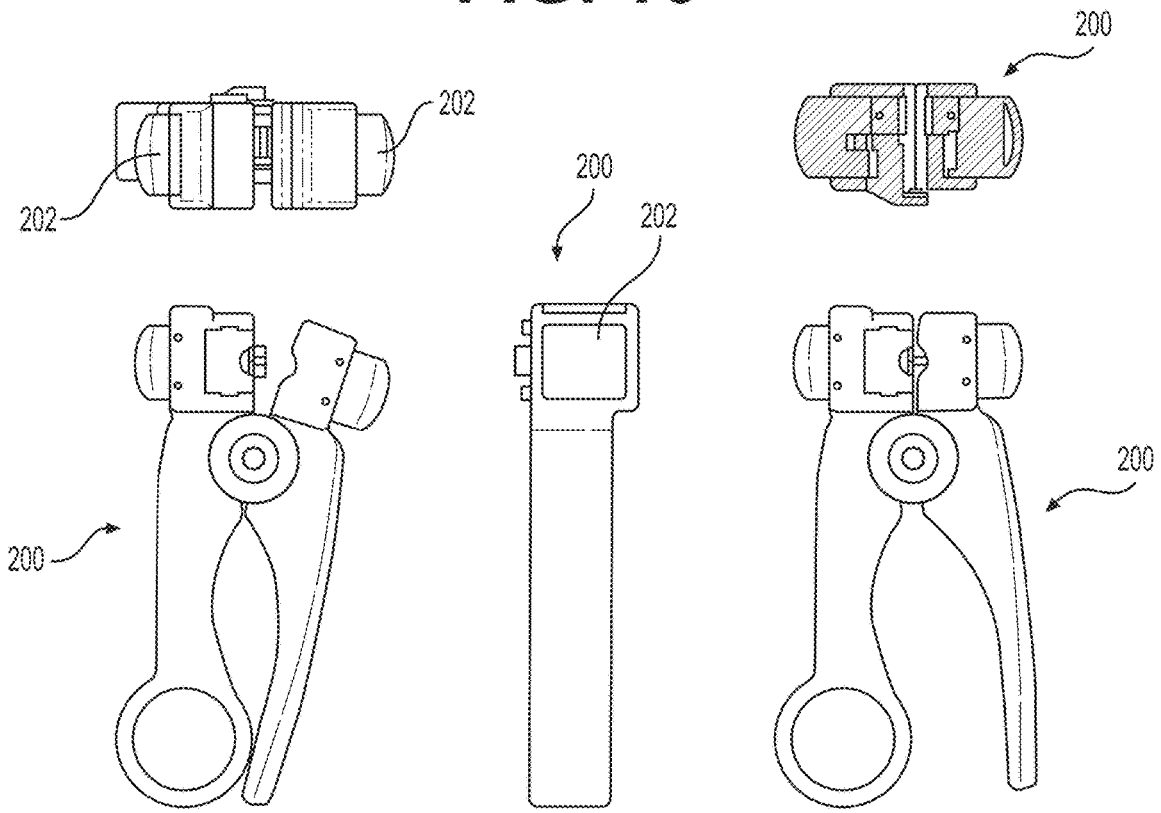
FIGS. 11A-11C are various views of a tool for preparing the cable for termination shown in FIG. 9A.
Figure 12A:
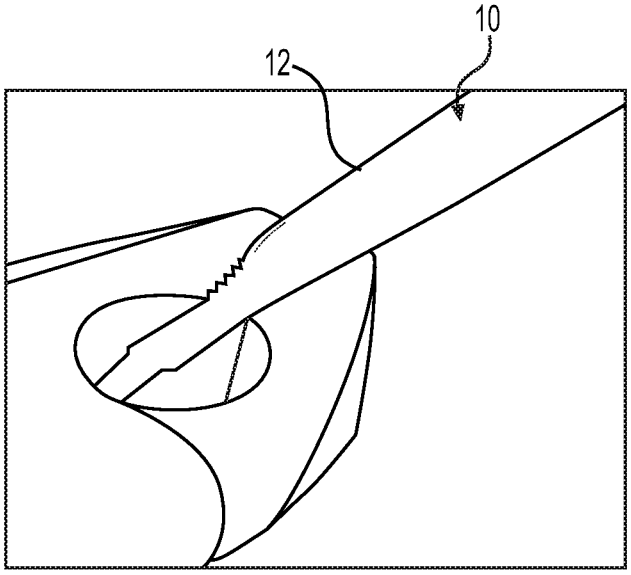
FIG. 12A (PRIOR ART)
FIGS. 12A and 12B are views of a conventional PVC cable jacket under high pressure and the distortion that results.
Figure 12B:
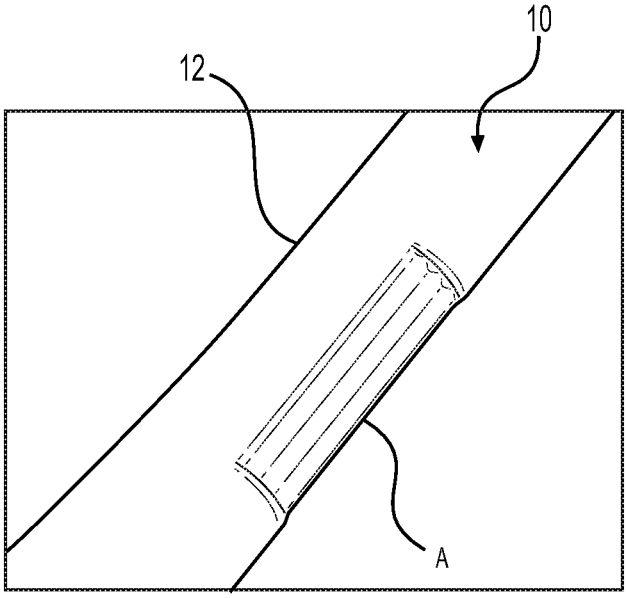
FIG. 12B (PRIOR ART)
Figure 13A:
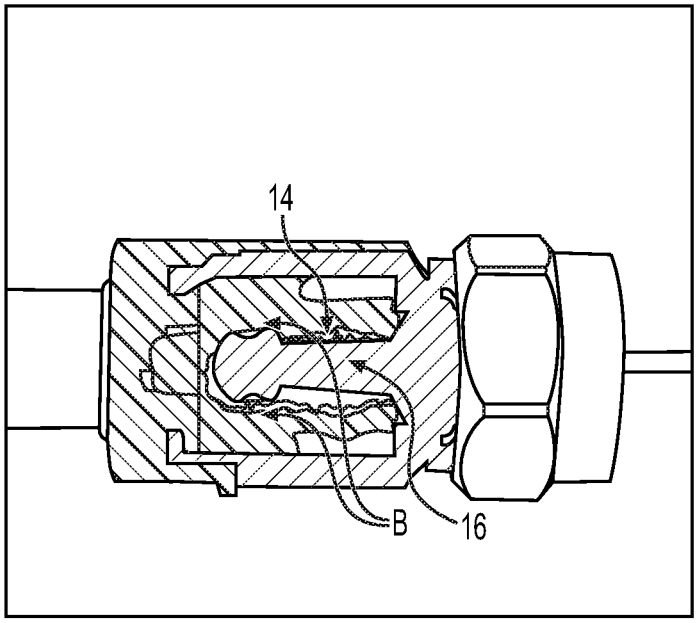
FIG. 13A (PRIOR ART)
FIGS. 13A and 13B are cross-sectional views of a conventional compression F connector.
Figure 13B:
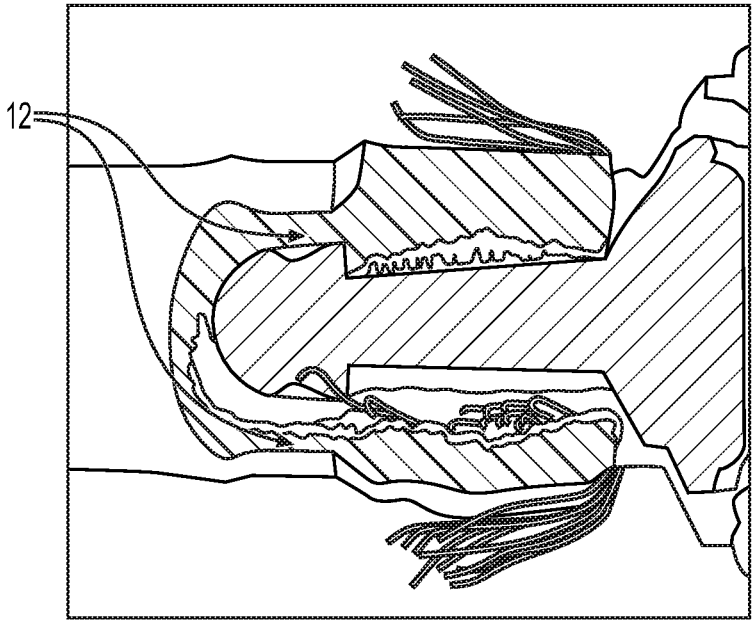
FIG. 13B (PRIOR ART)

The above steps may be done with just one cable preparation or stripping tool 200, seen in FIGS. 11A-11C. The tool 200 of the present invention may be configured to provide the industry standard ¼¼ cable preparation and to also have the unique features of being able to then apply the two lateral cable jacket slits 26 to the cable's outer jacket at the same time. This may be accomplished by pressing in two lateral buttons 202 on the end of the tool, which then engage two lateral cutting blades 204 (FIG. 10) which cut through the cable's jacket 12 and any foil bonded underneath the jacket 12. This then allows the split portions of the cable jacket 12 (formed by lateral slits 26) to open, as the connector's post end 110 is inserted underneath the cable's outer conductor or braid 14. This allows grounding pressure to be applied by the cable jacket 12 via the creep compensation inserts 160 or sleeve 160'.

Figure 9C:
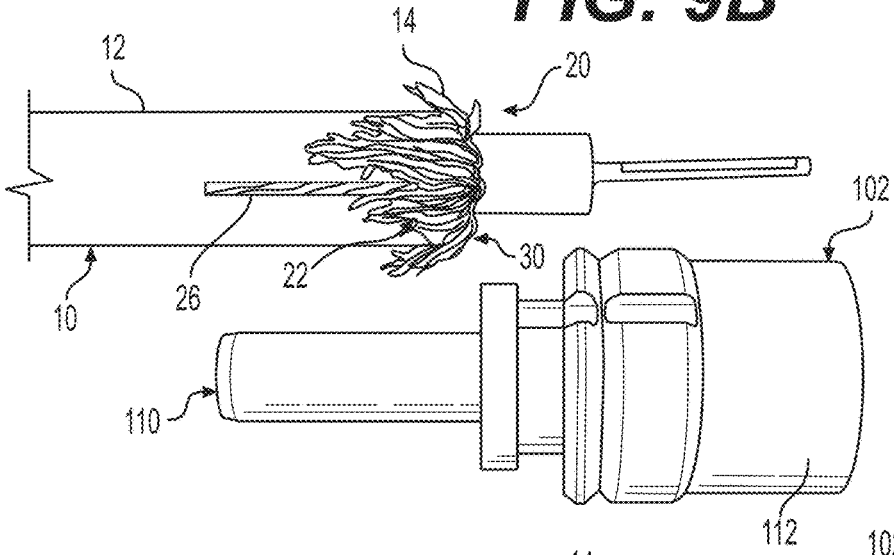
Figure 9D:
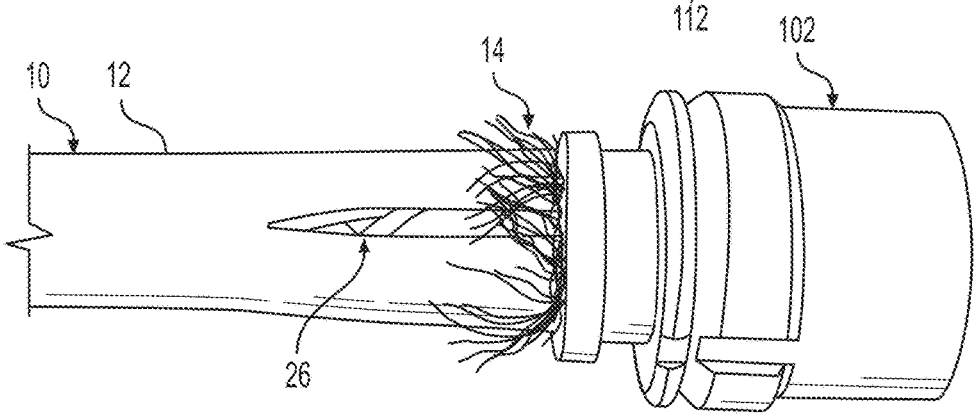

As seen in FIGS. 9C and 9D, the exposed portion 22 of the cable's braiding 14 may then be folded over the end of the outer jacket 12 to provide a post lead-in 30 at the termination end 20 of the cable 10. The post end 110 may then be installed onto the cable's termination end 20 by inserting the post end 110 into and through the post lead-in 30 of the outer conductor 14, thereby electrically connecting the cable's outer conductor or braid 14 and the post end 110.

During insertion of post end 110 into the cable's termination end 20, the cable's jacket 12 will open at the slits 26 (as seen in FIG. 9D), leaving the cable's braiding 14 formed over the post end 110. This leaves a gap, e.g. a minimum 1 mm gap, between each split portions of the cable jacket 12. The connector body's half sections 120 and 122, which have the creep compensation inserts 160 fitted therein (e.g. in the recessed areas 164), are then closed around the cable jacket 12 and its split portions, which are then easily compressed by the creep compensation inserts 160. Alternatively, the one-piece sleeve 160' may be mounted directly onto the connector's post end 110 and then the outer body half sections 120 and 122 may be closed around the sleeve 160'. Each way can be accomplished without exceeding the cable jacket's tensile strength and thus applies a uniform or nearly uniform 360° pressure to the entire or nearly the entire length of the post 110 end. This provides optimum metal-to-metal contact, and thus optimum grounding connection over time between connector 100 and the cable 10.

Without the two lateral slits and gap of the present invention, pressure is forced over the entire solid cable PVC jacket 12, the jacket in effect forming a 360-degree tube. This pressure then must transfer onto the cable's internal braiding 14, and then onto the connector's post in order to form the required grounding pressure. In addition, there is typically a metal foil bonded onto the inner part of the cable jacket, which is typically PVC. As such, when a conventional connector compresses the PVC jacket to apply pressure onto the connector's post, a very large amount of pressure must be applied onto the PVC jacket in order to deform the jacket and allow it to transfer the pressure onto the post for a proper grounding connection.

The lateral slits 26 of the present invention allow the jacket 12 to split open and leave a gap when the post end is inserted into the cable's prepared end. As a result, the jacket 12, such as a PVC jacket with bonded, foil is no longer a solid 360-degree tube. This allows any compression pressure over the split portions of the split cable jacket 12 to be applied immediately and directly onto the cable' outer conductor or braiding 14, and hence onto the connector's post end 110 for grounding. Optimum grounding pressure can now be applied via the cable jacket 12 without exceeding the PVC polymer tensile strength and elongation break percentage. This also prevents material creep and ensures optimum cable/grounding to the connector post end 110 over time. Another advantage of the present invention is the pressure is applied down the full length of the connector post end 110, thereby ensuring optimum grounding surface area.

While particular embodiments have been chosen to illustrate the invention, it will be understood by those skilled in the art that various changes and modifications can be made therein without departing from the scope of the invention as defined in the appended claims.

What is claimed is:

1. A cable connector, comprising:

an inner subassembly comprising a coupling nut for coupling to a mating connector or port and a post end for electrically connecting to a cable; and an outer body comprising separable sections forming an inner bore that receives at least the post end of the inner subassembly, each section having a proximal end and a distal end, the distal ends being configured to accept the cable, and each section having at least one engagement feature that cooperates with at least one corresponding engagement feature of the other section for assembly of the sections together in a closed position around the inner subassembly.

2. The cable connector of claim 1, wherein the sections of the outer body are half sections and the outer body further comprising a connecting piece connecting the proximal ends of the half sections, the connecting piece being coupled to a transition portion of the inner subassembly between the coupling and post ends.

3. The cable connector of claim 2, wherein the connecting piece is press-fit onto the transition portion of the inner subassembly.

4. The cable connector of claim 2, wherein the connecting piece has a keying feature that engages a corresponding keying feature of the transition portion.

5. The cable connector of claim 1, wherein at least one of the inner subassembly or the outer body is a unitary one-piece member.

6. The cable connector of claim 1, wherein the inner subassembly is formed of a conductive material and the outer body is formed of a dielectric material.

7. The cable connector of claim 1, wherein the sections of the outer body are half sections and the engagement features of the half sections are located at the distal ends thereof, respectively.

8. The cable connector of claim 1, wherein the sections of the outer body are half sections and the half sections include another set of engagement features at or near the proximal ends, respectively.

9. The cable connector of claim 1, wherein the engagement features form a snap engagement.

10. The cable connector of claim 1, further comprising a creep compensation insert received in the inner bore of the outer body.

11. A coaxial cable connector assembly, comprising:

a cable having inner and outer conductors and an outer jacket; and a coaxial connector comprising:

an outer body having sections configured to engage one another to form an inner bore;

an inner subassembly including a coupling nut for coupling to a mating connector or port and a post end receivable in the inner bore of the outer body, the post end being inserted into a prepared end of the cable so that the outer conductor of the cable is in electrical grounding contact with the post; and a creep compensation insert received in the inner bore between the post end and inner surfaces of the half sections, the creep compensation insert being configured to limit material creep of the outer jacket of the cable terminated to the coaxial connector.

12. The assembly of claim 11, wherein the creep compensation insert is formed of silicone and the outer jacket of the cable is formed of PVC.

13. The assembly of claim 11, wherein the sections of the outer body are half sections and two creep compensation inserts are received in respective recessed areas in the inner surfaces of the half sections of the outer body and surrounding the post end.

14. The assembly of claim 11, wherein the creep compensation insert is a sleeve inserted over the post end.

15. The assembly of claim 11, wherein the outer body is formed of a dielectric material and is a unitary one-piece member.

16. Method of terminating a cable with a cable connector, the cable connector comprising an outer body and an inner subassembly, comprising the steps of:

assembling the outer body to the inner subassembly by coupling a connecting piece of the outer body with a portion of the inner subassembly and with separable sections of the outer body being disengaged and in an open position, the inner subassembly having a coupling nut for coupling to a mating connector or port and a post end for electrically connecting to the cable;

after assembling the outer body to the inner subassembly, terminating a prepared end of the cable with the post end of the inner subassembly, thereby electrically connecting the cable and the inner subassembly, while the sections of the outer body remain disengaged and in the open position; and after terminating the prepared end of the cable with the post end of the inner subassembly, assembling the sections together via cooperating engagement features to a closed position, thereby clamping the cable therebetween.

17. The method of claim 16, wherein the sections of the outer body are half sections; and the step of assembling the half sections of the outer body together includes snap fitting the half sections.

18. The method of claim 16, wherein the outer body is dielectric and the inner subassembly is conductive.

19. The method of claim 16, wherein the sections of the outer body are half sections; and further comprising the step of releasing the cooperating engagement features to disengage the half sections of the outer body from the cable and move the half sections to the open position.

20. A method of terminating a cable with a coaxial cable connector, comprising the steps of:

preparing a termination end of the cable by, removing an end portion of an outer jacket thereof, that is formed of dielectric material, at a termination end of the cable to expose a portion of an outer conductor of the cable commensurate with the end portion removed from the outer jacket, forming one or more lateral slits in a predetermined portion of the outer jacket and in the outer conductor, at the termination end of the cable, and folding back the exposed portion of the outer conductor to provide a post lead-in at the termination end of the cable;

installing the coaxial connector onto the termination end of the cable by inserting a post end of the coaxial connector into the post lead-in of the outer conductor, thereby electrically connecting the outer conductor of the cable and the post end of the coaxial connector; and clamping the termination end of the cable between sections of an outer body of the coaxial cable connector.

21. The method of claim 20, wherein a length of the one or more lateral slits of the predetermined portion of the outer jacket is generally the same as the length of a cable termination end of the post.

22. The method of claim 20, wherein the outer jacket slits at the one or more lateral slits when the post end is inserted into the termination end of the cable.

23. The method of claim 20, wherein the one or more lateral slits are two lateral slits located on opposite sides of the outer jacket.

24. The method of claim 20, wherein the sections of the outer body are half sections; and further comprising the step of snap fitting together the half sections around the post end of the coaxial cable connector when claiming the termination end of the cable.

25. The method of claim 20, further comprising the step of inserting a creep compensation insert in the outer body prior to clamping the termination end of the cable, the creep compensation insert is configured to limit material creep of the outer jacket when clamping the termination end thereof.

26. The method of claim 25, wherein the creep compensation insert is a unitary one-piece sleeve inserted over the post end.

27. The method of claim 25, wherein two creep compensation inserts inserted into a recess of one of the half sections of the outer body of the coaxial cable connector.

* * * * *